US006249079B1

(12) United States Patent
Vollkommer et al.

(10) Patent No.: US 6,249,079 B1
(45) Date of Patent: Jun. 19, 2001

(54) FLUORESCENT LAMP WITH SPACERS AND LOCALLY REDUCED LUMINESCENT MATERIAL LAYER THICKNESS

(75) Inventors: Frank Vollkommer, Buchendorf; Lothar Hitzschke, Munich, both of (DE)

(73) Assignee: Patent-Trehand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/446,014

(22) PCT Filed: Apr. 9, 1999

(86) PCT No.: PCT/DE99/01093

§ 371 Date: Dec. 16, 1999

§ 102(e) Date: Dec. 16, 1999

(87) PCT Pub. No.: WO99/54914

PCT Pub. Date: Oct. 28, 1999

(30) Foreign Application Priority Data

Apr. 20, 1998 (DE) ..... 198 17 476

(51) Int. Cl.[7] ..... H01J 61/35

(52) U.S. Cl. ..... 313/292; 313/493; 313/495; 313/292

(58) Field of Search ..... 313/489, 25, 292, 313/495, 496

(56) References Cited

U.S. PATENT DOCUMENTS

| | | | | |
|---|---|---|---|---|
| 5,232,549 | * | 8/1993 | Cathey et al. | 456/633 |
| 5,714,840 | * | 2/1998 | Tanabe et al. | 313/581 |
| 5,734,224 | * | 3/1998 | Tagawa et al. | 313/493 |

FOREIGN PATENT DOCUMENTS

| | | |
|---|---|---|
| 19526211 | 1/1997 | (DE) . |
| 19636965 | 3/1998 | (DE) . |
| 9423442 | 10/1994 | (WO) . |

OTHER PUBLICATIONS

Patent Abstracts of Japan, vol. 199, No. 504, May 31, 1995 (1995 05 31) & JP 07 014555 A (Ushio Inc), Jan. 17, 1995 (1995–01–17) abstract.

* cited by examiner

*Primary Examiner*—Vip Patel
*Assistant Examiner*—Ken A Berck
(74) *Attorney, Agent, or Firm*—Robert F. Clark

(57) ABSTRACT

A description is given of a fluorescent lamp having spacers 6 for supporting a wall 2 of the discharge vessel, the fluorescent layer 3 having (8) a reduced thickness in a surrounding region of the spacer 6.

28 Claims, 1 Drawing Sheet

FLUORESCENT LAMP WITH SPACERS AND LOCALLY REDUCED LUMINESCENT MATERIAL LAYER THICKNESS

BACKGROUND OF THE INVENTION

The present invention relates to a fluorescent lamp for dielectrically impeded discharges. Such a fluorescent lamp has a discharge vessel filled with a gas filling, in the case of which at least one wall contains a transparent surface for the exiting of light. Moreover, the fluorescent lamp naturally has a fluorescent layer, consideration being given in the case of this invention to the case that at least a portion of the fluorescent layer is situated on said transparent surface. The electrodes and the dielectric layer thereon are not addressed further here.

It is possible in the case of such fluorescent lamps to use spacers which connect parts of the discharge vessel and keep them at a spacing from one another. In this case, the spacers can themselves be part of the discharge vessel, for example connecting, as frame, two plates of a flat radiator discharge vessel. On the other hand, particularly in the case of discharge vessels of planar extent and when the pressure of the gas filling is considerably below atmospheric pressure, it is necessary also to provide, inside the discharge vessel, spacers which are intended to prevent an implosion of the discharge vessel, but which do not belong directly to it in the sense of a boundary. It can also be advantageous for other reasons than the risk of implosion to undertake additional stabilization using spacers in a discharge vessel.

DESCRIPTION OF PRIOR ART

As regards the prior art, reference is made to the following applications, which represent fluorescent lamps of the type described for dielectrically impeded discharges, and whose disclosure content is also incorporated here:
DE 196 36 965.7=WO 97/01989
DE 195 26 211.5=WO 97/04625 and
DE-Patent 43 11 197.1=WO 94/23442.

SUMMARY OF THE INVENTION

This invention is based on the technical problem of developing a fluorescent lamp of the type mentioned at the beginning such that it exhibits good light-emitting properties in conjunction with good mechanical stability.

According to the invention, this problem is solved with the aid of a fluorescent lamp for dielectrically impeded discharges, having a discharge vessel filled with a gas filling, and at least one spacer for supporting at least one wall of the discharge vessel which has a surface, at least partially transparent to visible radiation, with a fluorescent layer, the spacer supporting this wall on this surface, wherein the fluorescent layer has a reduced thickness in a surrounding region of the spacer.

It has emerged in developing the invention that spacers in the region of a surface, provided for the light emission, of the discharge vessel lead to irregularities, in particular to shadows. However, for many applications it is very disadvantageous if the luminance of the light exit surface of the fluorescent lamp varies too greatly. Rather, the aim is for the light to be generated uniformly as far as possible. This relates chiefly to flat radiators for the backlighting of display devices, in particular for the backlighting of liquid crystal display screens. In order not to disturb the appearance and the legibility of the display device or of the display screen, it is preferable for luminance fluctuations of 15% not to be exceeded. However, the invention is not limited to the field of flat radiators or backlightings for display devices.

It has emerged in the case of the invention that a local reduction in the layer thickness of the fluorescent layer does not, as might be expected at first, lead to darkening because of the smaller available quantity of fluorescent material generating visible light. On the contrary, the locations with a thinned fluorescent layer appear comparatively brighter than the surrounding region, even if the layer thickness is reduced to zero, that is to say a local cutout is formed. This can be understood in retrospect by the diffuse character of the generation of light inside the fluorescent lamp, the visible radiation captured from neighboring regions encountering a lesser absorption/reflection in the region of the thinned fluorescent layer thickness. The invention accordingly provides a local reduction in layer thickness in the surrounding region of the spacer on the partially transparent surface with the fluorescent layer. In this case, the invention includes the case when the reduced thickness (in accordance with claim 1) is zero, that is to say the local change in layer thickness corresponds to a cutout.

Consequently, it is possible on the one hand to compensate a shadow from the spacer situated therebelow given suitable geometric coordination. On the ocher hand, it is also possible in the case of the solution according to the invention for there to remain in the region of the immediate contact between the spacers and transparent wall a somewhat darker spot which is, however, optically resolved, as it were, according to the invention in a brightened surrounding region. On the one hand, this is a question of the observers distance and the geometric extent of the brighter surface and the darker spot. On the other hand, an already known compensatory measure such as optical diffusers, prismatic disks and the like can be used to effect, as it were, a local averaging in the case of which the dark spot and the brightened surrounding region compensate one another.

One refinement of this invention consists in that said surrounding region of the spacer has a relatively finely configured geometric structure composed of many surfaces each having a different luminous layer thickness. In this case, a gradation of an effective luminous layer thickness, resulting to a certain extent from a local averaging, into discrete stages or as a continuous course can be performed by varying the different luminous layer thicknesses or varying the different surface proportions. Regarding this refinement, reference is made to the parallel application entitled "Leuchtstofflampe mit auf die geometrische Entladungsverteilung abgestimmter Leuchtstoffschichtdicke" ["Fluorescent lamp having a fluorescent layer thickness coordinated with the geometric discharge distribution"], which was filed on the same date by the same applicant.

A further idea of the invention is aimed at configuring the bearing surface between the spacer and the wall considered here to have as small an extent as possible. Certainly, mechanical considerations oppose this, specifically the avoidance of a punctiform loading of the wall (generally made from glass) by the spacer. However, this disadvantage is accepted for the benefit of minimizing the surface which can be brightened up by the reduction in layer thickness according to the invention. It is preferred in this case to limit this bearing surface in a two-dimensional fashion, that is to say to extend it less in each direction conceivable in this plane. On the other hand, there are cases, chiefly in the case of spacers running linearly, for example as frames of a discharge vessel, in which limiting the bearing surface in only one direction (perpendicular to the line of the spacer) is advantageous.

A quantitative characterization of this limitation of the bearing surface relates usefully to the spacing, bridged by the spacer, of the discharge vessel, that is to say, for example, to the plate spacing of a flat radiator fluorescent lamp. In this case, the small extent described for the bearing surface should be less than 30%, preferably less than 20% or 10% of this spacing.

A further important refinement of the invention relates to the stability of the discharge vessel with the spacers in the case of thermal cycles, such as unavoidably occur in practice during operation of the lamp. When developing the invention, it emerged in this case as essential for the coefficients of thermal expansion of the various main components of the discharge vessel and the spacers to be coordinated with one another. In particular, the coefficient of thermal expansion of the spacers should be in the region of ±30% of the coefficients of expansion of the main components of the discharge vessel. Main components of the discharge vessel are taken to mean those components whose thermal expansion owing to their geometric dimensions and their function in the discharge vessel is important for the thermal expansion of the overall discharge vessel. In the case of a flat radiator, these are, for example, the two plates and the frame connecting them. Depending on the extent of the thermal loads during operation, mismatches in this region lead to internal strains and displacements of the vessel components and the spacers relative to one another, and thus to instabilities and to the loosening of connections as far as breakage of the lamp.

Soft glasses have proved to be favorable materials for the spacers. Such soft glasses can also be used in a further processed form in terms of materials technology, for example as powder held together by a binder, or solder glass. Various ceramic materials, in particular $Al_2O_3$ ceramic, come into consideration, finally. Reference may be made to the exemplary embodiment concerning the question of the selection of material and the coefficients of expansion.

With regard to the already mentioned minimization of the bearing surface of the spacer on the transparent surface of the wall, it has emerged that a fixed connection between the spacer and wall is not necessarily advantageous. Rather, it can be advantageous for the spacer to be fastened only toward the other side, that is to say on the opposite wall, by which it is fixed when mounting is completed. By suitable geometric design, the wall with the transparent surface rests only on the spacer, no further connecting materials such as solder glass, adhesives or similar being provided. The bearing surface can thereby be minimized.

Furthermore, this also offers an advantage with regard to any differences in thermal expansion between the two walls connected by the spacer. In the case of transverse displacements produced thereby, the wall only bearing against the spacer can slip against it before excessively high stresses occur.

A further possibility for reducing the optical interference from an image of the spacer consists in sheathing the latter with a fluorescent layer. As a result, the spacer no longer appears, or appears in a less pronounced fashion, as a shadow on the other side of the transparent wall, specifically apart from the region of direct contact between the spacer and wall. Too little ultraviolet light reaches there to excite the fluorescent material to an appreciable extent.

Since the fluorescent sheathing of the spacer enlarges the bearing surface at the wall, it should be made clear that through the shining of this fluorescent layer, the region where the fluorescent layer bears against the wall does not appear as a shadow to an extent comparable with the uncoated spacer to the extent that there is sufficient ultraviolet light available for excitation. Consequently, the effective bearing surface to be evaluated in the sense of the foregoing considerations for minimizing the bearing surface is that of the spacer without the fluorescent layer (or only with regions of the fluorescent layer which are not sufficiently excited).

A further possibility for brightening up the surrounding region of the spacer consists, according to the invention, in a reflecting coating of a region of the spacer facing the transparent wall. This intensifies the launching of the light diffusely distributed inside the discharge vessel into the region, thinned according to the invention, of the fluorescent layer on the wall.

As already mentioned at the beginning, the brightening up, effected by the various measures represented, of a surrounding region of the spacer can be distributed with the aid of diffusely scattering media, so that the dark spot, which is unavoidable at least in the region where the spacer and wall bear directly against one another, has been resolved after passage through the diffusely scattering medium in the bright surrounding region or has been averaged away against it.

When working on this invention, a milk-glass layer proved to be a particularly favorable compromise between a strongly diffusely scattering effect, on the one hand, and as high a transmissivity as possible for the benefit of a high efficiency of the overall arrangement, on the other hand. It can be useful for technical reasons for the layer directly bounding the discharge volume to be constructed from a glass specified from other technical considerations, whereas the milk-glass layer is constructed thereover as an overlaying layer.

However, for the purpose of simplifying the overall design it is also possible in the case of batch-quantities suitable for appropriate fabrication of specific milk glasses to construct the transparent wall in principle (in one layer) from a milk glass.

In the case of the possibility already mentioned at the beginning of a frame of a flat radiator discharge vessel as a spacer in the sense of the invention, there is the advantage of enlarging the effective luminous surface. This will be explained in the exemplary embodiment.

A concrete exemplary embodiment of the invention is described in more detail below and represented in the attached figures. The individual features disclosed in this case can also be essential to the invention in other combinations. In detail:

DESCRIPTION OF THE PREFERRED EMBODIMENTS

Figure 1:
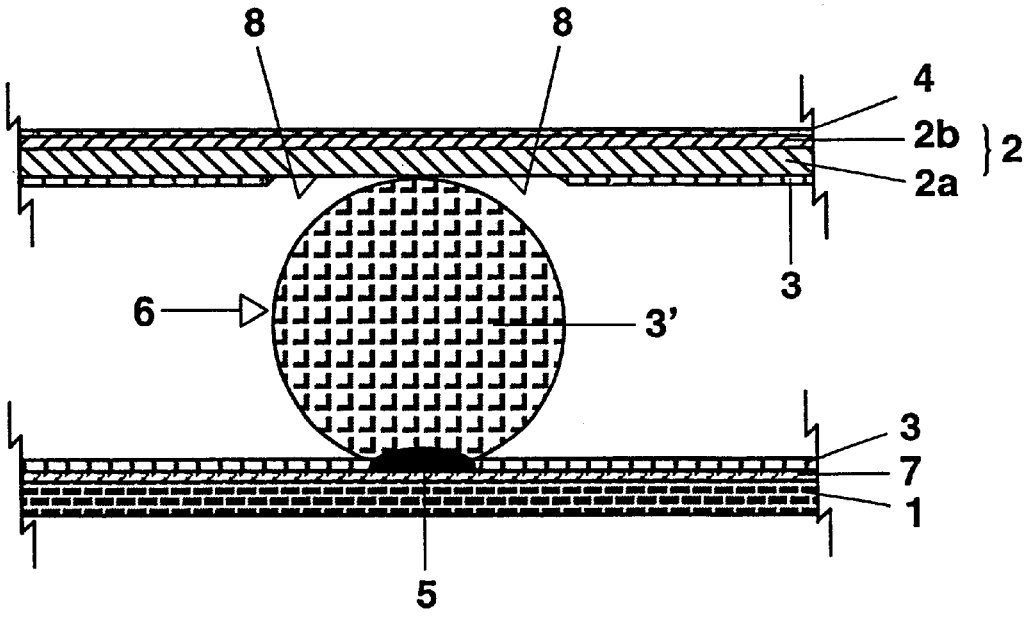
FIG. 1 shows a schematic partial representation which represents a spacer in a flat radiator fluorescent lamp according to the invention in cross section, the spacer being surrounded all around by a cutout in a fluorescent layer.

FIG. 1 shows a cross-sectional view of a flat radiator fluorescent lamp according to the invention. The fluorescent lamp is designed for dielectrically impeded discharges and constructed in this case largely in a known way, reference being made to the prior art already cited. In particular, the electrode arrangements and the dielectric layers characteristic of the dielectrically impeded discharge are not further dealt with below.

FIG. 1 here shows a partial view which represents only a region of a spacer 6 with a part of a base plate 1 and a cover plate (denoted in summary fashion by 2) around the spacer 6.

The spacer 6 comprises a precision glass sphere with a diameter of 5 mm. For example, an arrangement of 48 such spacers 6 would be used in the case of a flat radiator fluorescent lamp with dimensions of approximately 315 mm×239 mm×10 mm given a thickness of the base plate 1 and of the cover plate 2 of 2.5 mm in each case.

The base plate 1 is provided with a reflecting layer 7 for reflecting the generated visible light toward the transparent cover plate 2. A fluorescent layer 3 is provided in each case on the side, facing the discharge volume, of the reflecting layer 7 and the cover plate 2. The spacer 6 is fastened on the base plate 1 by means of a solder glass 5 which is applied as a viscous mixture of a soft glass powder and a binder and dried and hardened by a heat treatment. Because of its spherical shape, the spacer 6 bears against the cover plate 2 in a virtually punctiform fashion, the remaining unavoidable bearing surface resulting from an elastic deformation and unevennesses of the surfaces involved. The fluorescent layer 3 is effaced on the cover plate around this bearing surface between the spacer 6 and the cover plate 2; that is to say, the bearing surface is situated in the middle of a cutout 8 in the fluorescent layer.

Moreover, the glass ball forming the spacer 6 is coated with a further fluorescent layer 3'. Owing to its finite thickness, this fluorescent layer 3' enlarges the bearing surface between the spacer 6 and the cover plate 2 slightly, as already setforth, the fluorescent layer 3' scarcely contributing further to the shading.

The ultraviolet light generated in a dielectrically impeded gas discharge is converted into visible light in the fluorescent layers 3 and 3', the result being a largely diffuse distribution of the visible light in the discharge volume. This is supported by the reflection at the reflecting layer 7, in order to minimize the losses in the region of the base plate 1. Consequently, visible light can be launched into the region 8 around the spacer 6 which is free of the fluorescent layer, the contribution, in particular, of the half of the fluorescent layer 3', facing the cover plate 2, on the spacer 6 being particularly important.

Because of the fact that the absorption and reflection of the fluorescent material is eliminated on the cover plate 2 by comparison with regions further away which have a normal thickness of the fluorescent layer 3, a particularly large quantity of light can penetrate through the cover plate 2 in the surrounding region of the spacer 6.

FIG. 1 further shows that the cover plate 2 is constructed from two component layers, specifically a lower glass layer 2*a* which, like the base plate 1, consists for reasons of materials technology of a B270 glass (described more precisely below), and a milk-glass overlaying layer 2*b* situated thereabove for diffusely scattering the exiting visible light. These reasons of materials technology relate, on the one hand, to working properties, specifically a favorably situated softening temperature of 708° C., and further to a good chemical resistance against the plasmas occurring, as well as against alkali migration inside the glass, the coefficients of thermal expansion dealt with in more detail below and, finally, favorable transmission properties.

Furthermore, there is located above the milk-glass overlaying layer 2*b* a prismatic foil 4 which narrows the solid angle of the light exit in terms of the centroids (so-called brightness-enhancement foil from the manufacturer 3M). Moreover, the prismatic foil also has the property of an additional averaging of the luminance beyond the effect of the milk-glass overlaying layer 2*b*.

It is also possible to use so-called DBEF foils from the manufacturer 3M (or foils of comparable function), which are essentially partially reflecting polarizers. It is therefore possible to enhance the yield in the case of application to backlighting of liquid crystal display screens by tuning to the polarization properties of a liquid crystal display.

Overall, the combination of the milk-glass overlaying layer 2*b* with the prismatic foil 4 leads to such far-reaching smoothing of the inhomogeneities of the luminance distribution that the small dark spot caused by direct bearing of the spacer 6 against the cover plate 2 is compensated by the brighter surrounding region in the region of the cutout 8 in the fluorescent material. Moreover, the brighter surrounding region in the region 8 compensates for the absence of the contribution of light from the region of the base plate 1 below the spacer 6, in particular from the region of the solder glass 5.

In its upper half in the figure, the glass ball forming the spacer 6 could furthermore be provided with a reflecting layer corresponding to the reflecting layer 7 instead of or underneath the fluorescent layer 3'.

Figure 2:
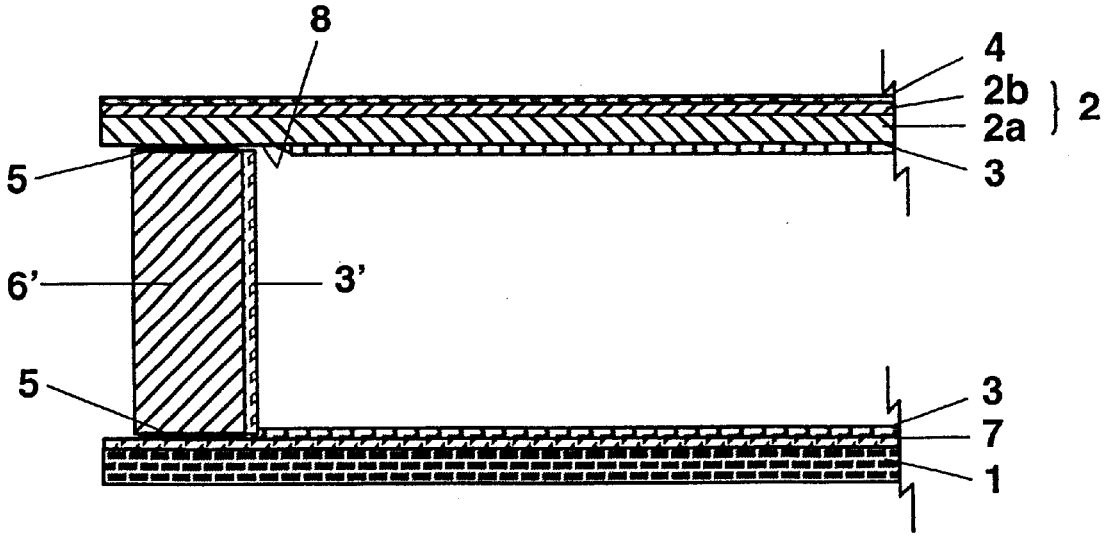
FIG. 2 shows a schematic partial view which represents in cross section a further spacer in the flat radiator fluorescent lamp according to the invention, the spacer corresponding to a flat radiator frame and being surrounded on one side by a cutout in the fluorescent layer.

FIG. 2 shows a cross-sectional representation largely comparable to FIG. 1, although an edge of the flat radiator fluorescent lamp is shown. Present there is a spacer 6' in the form of a glass frame, which forms the discharge vessel at the edge and between the plates 1 and 2 and is made from the B270 glass described further below. On its top side and on its underside, this glass frame is connected to the base plate 1 and the cover plate 2 via solder glass layers 5. For reasons of stability, no minimization of a bearing surface on the cover plate 2 is provided here, either. Rather, the glass frame 6' has the cross-sectional shape of a rectangle on its end with a flat bearing surface top and bottom.

To the side of the discharge volume, to the right in the figure, the spacer or the glass frame 6' is provided with a fluorescent layer 3' which has the function analogous to the corresponding fluorescent layer on the glass ball in the previous figure. In accordance with the elongated (quasi one-dimensional) geometry of the spacer 6', a thinned region 8 is formed in the fluorescent layer 3 of the cover plate 2 only toward one side, again, specifically toward the discharge volume. In this thinned region 8, the thickness of the fluorescent layer 3 reduces with decreasing lateral spacing from the spacer 6' to approximately zero at the point of contact with the fluorescent layer 3'. Starting from the beginning of the reduction in layer thickness, this transition is essentially linear, wherein the precise mathematical course of this smooth reduction in layer thickness, and the precise layer thickness (theoretically zero) in the immediate surrounding region of the fluorescent layer 3' can be controlled only to a limited extent for reasons of production engineering.

Otherwise, the design of the layers corresponds entirely to the design from FIG. 1, and will not be described in more detail here. What is involved is merely a cross section through a different point of the fundamentally identical layer structure.

The advantage of the invention consists at this point in that darkening of the lamp in the vicinity of the frame or the spacer 6' can be compensated by the contribution of diffuse radiation lacking from the side of the glass frame 6'. A typical width for the region 8 of the reduction in layer thickness is up to 1 cm and corresponds to the darkened region without a reduction in layer thickness.

Moreover, it is also possible to enlarge the effective luminous surface in that the smoothing effect of the milk-glass overlaying layer 2*b* or else of an external optical diffuser and the prismatic foil 4 ensures there is a "smearing out" of the brightness increased in the region 8 beyond the region, already darkened per se, of the glass frame 6'.

In the form represented, the glass frame 6' is led as a rectangle around a flat radiator geometry which is rectangular in plan view. The result of this is a widening of the luminous region on all sides of the flat radiator, and thus overall an enlarged "visible diagonal" of the actually luminous surface.

The following may be stated regarding the various glass materials which come into consideration: in general, a distinction is made between soft glasses and hard glasses, the distinguishing criterion being the level of the softening temperature (with $10^{7.6}$ dPas). In the case of this invention, use is predominantly made of intermediate glasses, but also of soft glasses, specifically in a range of the coefficient of thermal expansion of $9\times10^{-6}$ $K^{-1}$±30% (preferably 20%, 10%). Usually, hard glasses fall in the range of $4\times10^{-6}$ $K^{-1}$ and soft glasses approximately in the range of $9\times10^{-6}$ $K^{-1}$.

Particular preference is given here to the glass B270 from the manufacturer DESAG (Deutsche Spezialglas AG in Gr ünenplan) with a coefficient of thermal expansion of $9.5\times10^{-6}$ $K^{-1}$ and a softening temperature of 708° C. Most soft glasses also lie in this range of the coefficient of thermal expansion, for which reason soft glass or materials based on soft glass are preferred for the spacers. Also coming into consideration is a so-called AR glass (No. 8350) from the said manufacturer, which has a coefficient of thermal expansion of $9.1\times10^{-6}$ $K^{-1}$. (The technical reasons already mentioned for B270 also apply largely to the AR glass.) Furthermore, it is also possible to use $Al_2O_3$ ceramic with a coefficient of thermal expansion of $8.5–8.8\times10^{-6}$ $K^{-1}$.

Disadvantageous, by contrast, is quartz glass, which is more frequently used because of the good UV transparency in this technical range. On the one hand, its average linear coefficient of expansion is approximately $4.5–5.9\times10^{-7}$ $K^{-1}$ and therefore amounts to only approximately 5–6% of the coefficient of the material used for the discharge vessel. Furthermore, quartz glass has the disadvantageous property of poor adhesion to most of the fluorescent materials coming into consideration. It is, moreover, expensive and therefore comes into consideration only in exceptional cases for producing the discharge vessel itself and, in principle, the spacer, as well.

What is claimed is:

1. A fluorescent lamp for dielectrically impeded discharges, having a discharge vessel (1, 2, 6') filled with a gas filling, and at least one spacer (6, 6') for supporting at least one wall (2) of the discharge vessel which has a surface, at least partially transparent to visible radiation, with a fluorescent layer (3), the spacer (6, 6') supporting this wall (2) on this surface, wherein the fluorescent layer (3) has a reduced thickness in a surrounding region (8) of the spacer (6, 6').

2. The fluorescent lamp as claimed in claim 1, in which the surrounding region has a geometric structure composed of surfaces of different fluorescent layer thickness.

3. The fluorescent lamp as claimed in claim 1, in which the surrounding region (8) has surfaces without a fluorescent layer.

4. The fluorescent lamp as claimed in claim 1, in which the spacer (6, 6') supports the wall (2) by bearing against it with a surface of small extent.

5. The fluorescent lamp as claimed in claim 4, in which the bearing surface is of small extent in every direction in its plane.

6. The fluorescent lamp as claimed in claim 4, in which the small extent is less than 30% of the plate spacing.

7. The fluorescent lamp as claimed in claim 1, in which the spacer (6, 6') has a coefficient of thermal expansion which corresponds with a tolerance of ±30% to that of the main components (1, 2, 6') of the discharge vessel.

8. The fluorescent lamp as claimed in claim 1, in which the spacer (6, 6') consists essentially of soft glass, a material essentially containing soft glass or a ceramic material.

9. The fluorescent lamp as claimed in claim 1, in which the spacer (6) bears against the wall (2) in a fashion free from connecting material.

10. The fluorescent lamp as claimed in claim 1, in which the spacer (6, 6') has an outer fluorescent coating (3').

11. The fluorescent lamp as claimed in claim 1, in which the spacer has a reflecting coating in a region facing the wall.

12. The fluorescent lamp as claimed in claim 1, in which the wall (2) has a milk-glass layer (2*b*).

13. The fluorescent lamp as claimed in claim 1, in which the spacer (6') forms a boundary wall of the discharge vessel (1, 2, 6').

14. The fluorescent lamp as claimed in claim 13, in which the spacer (6') is a frame of a flat radiator fluorescent lamp which connects a base plate (1) and a cover plate (2) forming the wall.

15. A fluorescent lamp for dielectrically impeded discharges comprising:

a discharge vessel filled with a gas filling;

the discharge vessel having a cover plate, a base plate, and at least one spacer situated between the base plate and the cover plate;

the cover plate having a surface, at least partially transparent to visible radiation, with a fluorescent layer;

the spacer being fastened to the base plate and having a bearing surface supporting the surface of the cover plate; and the fluorescent layer having a reduced thickness in a region surrounding the bearing surface of the spacer so that a larger quantity of light can penetrate the cover plate in the region surrounding the bearing surface.

16. The fluorescent lamp as claimed in claim 15 wherein the base plate has a reflecting layer and a fluorescent layer.

17. The fluorescent lamp as claimed in claim 15 wherein the spacer has an outer fluorescent coating.

18. The fluorescent lamp as claimed in claim 15 wherein the fluorescent layer is removed in a region surrounding the bearing surface of the spacer to form a cutout.

19. The fluorescent lamp as claimed in claim 15 wherein the spacers are spherical.

20. The fluorescent lamp as claimed in claim 15 wherein the spacer forms a boundary wall of the discharge vessel.

21. The fluorescent lamp as claimed in claim 20 wherein the spacer forming the boundary wall is a frame which connects the cover plate and the base plate.

22. The fluorescent lamp as claimed in claim 20 wherein the thickness of the fluorescent layer of the cover plate reduces with decreasing lateral spacing from the boundary wall.

23. The fluorescent lamp as claimed in claim 15 wherein the spacer bears against the cover plate in a virtually punctiform fashion.

24. The fluorescent lamp as claimed in claim 20 wherein the spacer has an outer fluorescent coating.

25. The fluorescent lamp as claimed in claim 21 wherein the lamp is a flat radiator lamp and the frame is rectangular.

26. The fluorescent lamp as claimed in claim 15 wherein the spacer has a reflecting coating.

27. The fluorescent lamp as claimed in claim 15 wherein the cover plate has a diffusely scattering medium.

28. A fluorescent lamp for dielectrically impeded discharges comprising:

a discharge vessel filled with a gas filling;

the discharge vessel having a cover plate, a base plate, and at least one spacer situated between the base plate and the cover plate;

the cover plate having a diffusely scattering medium and a surface, at least partially transparent to visible radiation, with a fluorescent layer;

the base plate having a reflecting layer and a fluorescent layer on a side facing the cover plate;

the spacer being fastened to the base plate and bearing against the cover plate in a virtually punctiform fashion, the spacer further having an outer fluorescent coating; and the fluorescent layer of the cover plate having a reduced thickness in a region surrounding the spacer so that a larger quantity of light can penetrate the cover plate in the region surrounding the spacer.

* * * * *